US009532132B2

(12) United States Patent
Nakaishi

(10) Patent No.: US 9,532,132 B2
(45) Date of Patent: Dec. 27, 2016

(54) HEARING-IMPAIRED PERSON ASSISTANCE SPEAKER

(71) Applicant: Shinichirou Nakaishi, Chiba (JP)

(72) Inventor: Shinichirou Nakaishi, Chiba (JP)

( * ) Notice: Subject to any disclaimer, the term of this patent is extended or adjusted under 35 U.S.C. 154(b) by 0 days.

(21) Appl. No.: 14/917,448

(22) PCT Filed: Sep. 3, 2014

(86) PCT No.: PCT/JP2014/073229

§ 371 (c)(1),
(2) Date: Mar. 8, 2016

(87) PCT Pub. No.: WO2015/033970

PCT Pub. Date: Mar. 12, 2015

(65) Prior Publication Data

US 2016/0227312 A1 Aug. 4, 2016

(30) Foreign Application Priority Data

Sep. 9, 2013 (JP) ..... 2013-185848

(51) Int. Cl.
*H04R 1/26* (2006.01)
*H04R 1/28* (2006.01)
(Continued)

(52) U.S. Cl.
CPC ..... *H04R 1/2811* (2013.01); *H04R 7/06* (2013.01); *H04R 7/16* (2013.01); *H04R 9/025* (2013.01); *H04R 9/04* (2013.01); *H04R 31/006* (2013.01)

(58) Field of Classification Search
CPC ..... H04R 1/28; H04R 31/006; H04R 7/16; H04R 7/06; H04R 9/04; H04R 9/025
(Continued)

(56) References Cited

U.S. PATENT DOCUMENTS 4,472,604 A 9/1984 Nakamura
4,989,254 A * 1/1991 Amalaha ..... H04R 1/345 381/182

(Continued)

FOREIGN PATENT DOCUMENTS

CN 1575030 A 2/2005
CN 102067627 A 5/2011

(Continued)

OTHER PUBLICATIONS

International Search Report dated Dec. 9, 2014 filed in PCT/JP2014/073229.

(Continued)

*Primary Examiner* — Disler Paul
(74) *Attorney, Agent, or Firm* — Rankin, Hill & Clark LLP

(57) ABSTRACT

It is a purpose of the present invention to provide a hearing-impaired person assistance speaker that emits sound waves having an increased sound pressure level so as to provide improved original sound production capabilities. The inner circumferential face of a coupler 199 is bonded to one end of a bobbin 124 that is the other end thereof around which a coil 148 is wound. A portion of the coupler 199 configured so that it extends outward is bonded to a vibrating unit 121. As described above, the bobbin 124 and the vibrating unit 121 are coupled with each other via the coupler 199, instead of a line-contact connection structure that connects them. This reduces an amount of adhesive agent that can lead to degradation in the sound clarity. Thus, the present embodiment provides improved sound clarity of the sound to be received by a hearing-impaired person.

1 Claim, 16 Drawing Sheets

(51) Int. Cl.

| | |
|---|---|
| ***H04R 31/00*** | (2006.01) |
| ***H04R 7/06*** | (2006.01) |
| ***H04R 9/04*** | (2006.01) |
| ***H04R 9/02*** | (2006.01) |
| ***H04R 7/16*** | (2006.01) |

(58) Field of Classification Search
USPC ..... 381/336, 412, 425
See application file for complete search history.

(56) References Cited

U.S. PATENT DOCUMENTS

| | | | | |
|---|---|---|---|---|
| 5,659,155 | A | 8/1997 | Porzilli | |
| 2001/0042657 | A1 | 11/2001 | Yoshii | |
| 2002/0114485 | A1 | 8/2002 | Shimamura | |
| 2003/0047378 | A1 | 3/2003 | Yoshii | |
| 2004/0013283 | A1* | 1/2004 | Coffin | H04R 9/045 381/418 |
| 2004/0252859 | A1* | 12/2004 | Saiki | H04R 1/2819 381/386 |
| 2006/0153413 | A1* | 7/2006 | Nakajima | H04R 1/021 381/345 |
| 2011/0142277 | A1 | 6/2011 | Bank | |

FOREIGN PATENT DOCUMENTS

| | | | |
|---|---|---|---|
| CN | 203596912 | U | 5/2014 |
| EP | 1107639 | A2 | 6/2001 |
| EP | 2297975 | A1 | 3/2011 |
| GB | 2402836 | A1 | 12/2004 |
| GB | 2424537 | A1 | 9/2006 |
| JP | 56063197 | | 5/1981 |
| JP | 57166491 | | 10/1982 |
| JP | 59125195 | | 8/1984 |
| JP | 60068796 | | 5/1985 |
| JP | 61139191 | A2 | 6/1986 |
| JP | 2001078285 | A2 | 3/2001 |
| JP | 2001224089 | A2 | 8/2001 |
| JP | 2002247675 | A2 | 8/2002 |
| JP | 2003116197 | A2 | 4/2003 |
| JP | 3115815 | | 10/2005 |
| JP | 2008137514 | A2 | 6/2008 |
| JP | 2011524710 | T2 | 9/2011 |
| JP | 2014068342 | A2 | 4/2014 |
| JP | 2015146632 | | 8/2015 |
| WO | 2009113319 | A1 | 9/2009 |
| WO | 2009153591 | A1 | 12/2009 |
| WO | 2014038102 | A1 | 3/2014 |

OTHER PUBLICATIONS

Extended European Search Report dated Sep. 13, 2106 issued in the corresponding European patent application No. 14841957.5.

* cited by examiner

HEARING-IMPAIRED PERSON ASSISTANCE SPEAKER

TECHNICAL FIELD

The present invention relates to a technique for providing improved hearing assistance for a hearing-impaired person or a hearing aid user.

BACKGROUND ART

FIG. 16A is a diagram showing an example configuration of a closed-type speaker 70 according to a conventional technique. The speaker 70 shown in FIG. 16A has a configuration in which a circular magnet 73 and a circular plate 74 are arranged on a back plate 71 such that they surround a center pole 72 provided to the plate 71. The neck portion of frame 75 is fixed to the front face of the circular plate 74. The inner circumferential face of the circular plate 74 and the outer circumferential face of the center pole 72 form a gap, i.e., a magnetic gap GP1, which houses a portion of a voice coil bobbin 76 around which a coil 77 is wound. The neck portion of a vibrating sheet 78 is bonded to a portion of the outer circumferential face of the voice coil bobbin 76 at a position slightly shifted from the end of the outer circumferential face of the voice coil bobbin 76. Furthermore, a circumferential edge of a cap 79 is bonded to the front face (sound emission plane) of the vibrating sheet 78 at a position slightly shifted toward the outer side from the neck portion of the vibrating sheet 78. Furthermore, the vibrating sheet 78 and the voice coil bobbin 76 are arranged such that they are surrounded by the inner circumferential face of the frame 75. Moreover, a damper 80 is provided between the outer circumferential face of the bobbin 76 and the inner circumferential face of the frame 75. The configuration of such a type of speaker is disclosed in Patent document 1, for example.

CITATION LIST

Patent Literature

[Patent Document 1]
Japanese Unexamined Utility Model Application Publication No. 2003-116197

SUMMARY OF INVENTION

Technical Problem

As shown in an enlarged view in FIG. 16B, in such a type of speaker, a bonding portion that connects the vibrating sheet 78 and the bobbin 76 has a structure in which the edge of the neck portion of the vibrating sheet 78 is bonded to the outer circumferential face of the bobbin 76 such that they are in line contact with each other. Furthermore, a bonding portion that connects the cap 79 and the vibrating sheet 78 has a structure in which the edge of the cap 79 is bonded to the surface of the vibrating sheet 78 such that they are in line contact with each other. However, such a structure requires a sufficient amount of adhesive agent BND applied to both the front side and the rear side of such line contact bonding portions. Otherwise, such a structure has the potential to have a problem in that the bonded components easily become detached from each other. In order to solve such a problem, in such a type of speaker according to conventional techniques, there is a need to apply a large amount of adhesive agent, which is a material that leads to degradation in the sound clarity. That is to say, it is difficult for such a structure to provide improved original sound reproduction capabilities.

The present invention has been made in order to solve such a problem. Accordingly, it is a purpose of the present invention to provide a speaker having improved original sound reproduction capabilities.

Solution of Problem

In order to solve the aforementioned problem, a speaker according to a preferred embodiment of the present invention comprises: an enclosure having an opening, and a cavity that communicates with the opening; a vibrating unit held by the inner circumferential face of the opening; a magnetic circuit having a magnetic gap, and held in the cavity side such that the magnetic gap faces the vibrating unit; and a bobbin having one end around which a coil is wound and which is housed within the magnetic gap, and the other end that is an end opposite to the aforementioned one around which a coil is wound and that is bonded to the vibrating unit. The aforementioned other end of the bobbin is configured as an extension portion that extends outward from the bobbin in a radial direction. The aforementioned extension portion is bonded to the vibrating unit.

In this speaker, the bobbin has a structure in which the opposite end to the one end thereof around which the coil is wound, is configured such that it extends outward in a radial direction from the bobbin. The extension portion is bonded to the vibrating sheet. Thus, to ensure sufficient bonding strength, such an arrangement requires only a small amount of an adhesive agent to be applied to only a portion between the vibrating unit and the extension portion configured such that it extends outward in the radial direction of the bobbin. Thus, with the present invention, such an arrangement has an advantage of a reduced amount of adhesive agent to be applied, as compared with a speaker having a structure in which the edge of the neck portion of the vibrating sheet is bonded to the outer circumferential face of the bobbin such that they are in line contact with each other. Thus, with the present invention, such an arrangement provides a speaker having improved original sound reproduction capabilities as compared with a speaker having a structure in which the edge of the neck portion of the vibrating sheet is bonded to the outer circumferential face of the bobbin such that they are in line contact with each other.

Another preferred embodiment of the present invention relates to a hearing-impaired person assistance speaker. The hearing-impaired person assistance speaker comprises: an enclosure having an opening, and a cavity that communicates with the opening; a vibrating unit held such that a sound emitting plane thereof faces the opening; a magnetic circuit having a magnetic gap, and held in the cavity such that the magnetic gap faces the vibrating unit; a bobbin having a structure in which a coil is wound around an outer circumferential face of one end thereof, and the aforementioned end around which the coil is wound is arranged within the magnetic gap; and a coupler having a cylindrical structure in which one end thereof is configured such that it extends outward. An inner circumferential face of the coupler is bonded to the other end of the bobbin, i.e., the end opposite to the end thereof around which the coil is wound. The portion of the coupler thus configured such that it extends outward is bonded to the vibrating unit. The enclosure has an egg-shaped curved inner wall. The vibrating unit comprises a honeycomb core having a hollow honeycomb structure and two films formed of an aluminum material and arranged so as to cover the honeycomb core from both sides thereof.

In the present hearing-impaired person assistance speaker, the enclosure has an egg-shaped curved inner wall. In a case in which the inner wall of the enclosure has an egg-shaped curved shape, such an arrangement is capable of suppressing the occurrence of standing waves in the cavity. Thus, such an arrangement provides an advantage of suppressing potential degradation of sound clarity due to interference from such standing waves that can occur in the enclosure. Thus, by installing and employing such a hearing-impaired person assistance speaker in a medical office in a medical institution, such an arrangement provides improved smooth communication between a doctor and a hearing-impaired person.

DESCRIPTION OF EMBODIMENTS

Description will be made below with reference to the drawings regarding embodiments of the present invention.

First Embodiment

Figure 1:
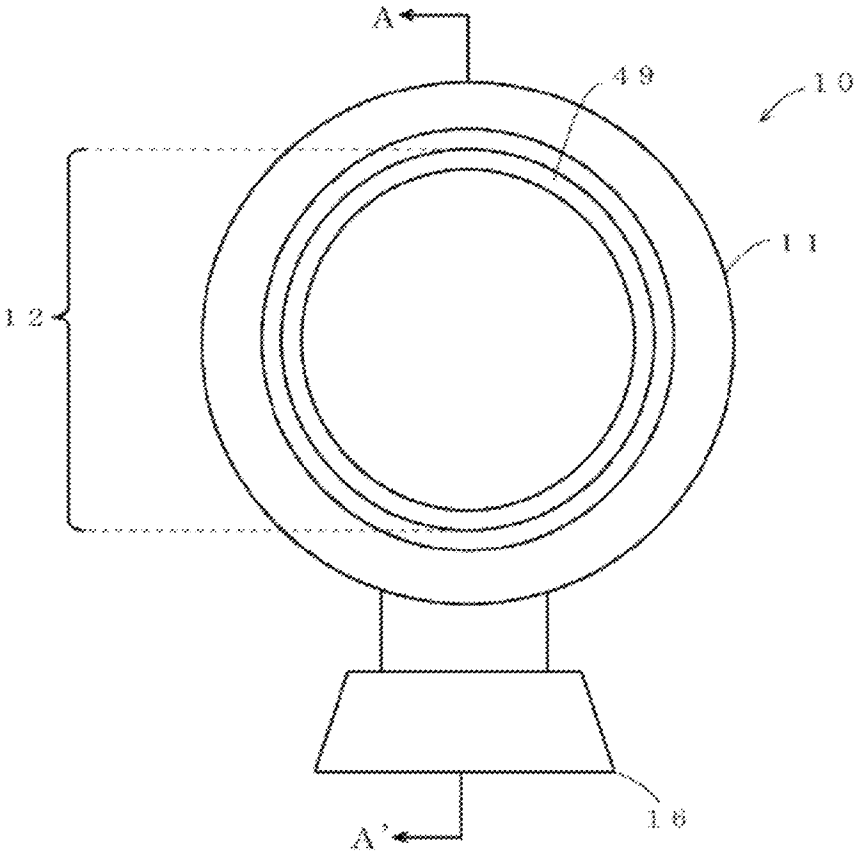
FIG. 1 is a front view of a speaker according to a first embodiment of the present invention.
Figure 2:
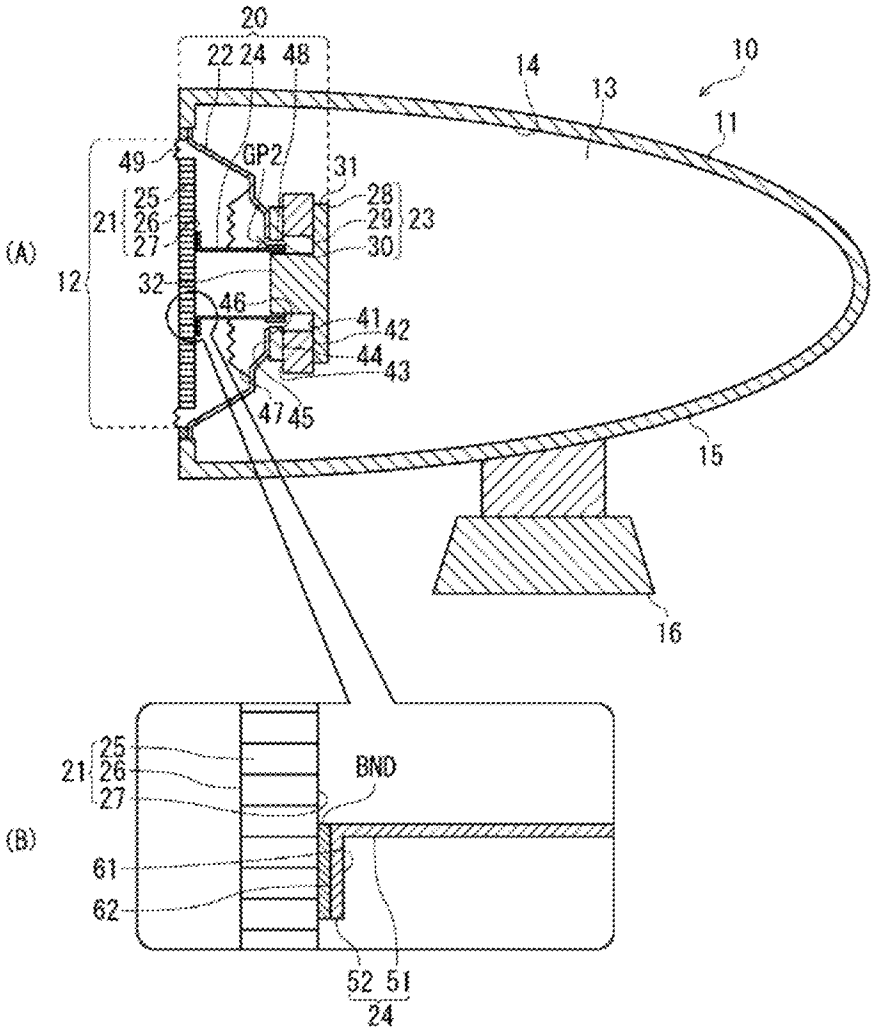
FIG. 2 is a cross-sectional view taken along line A-A' shown in FIG. 1, and an enlarged view of a part of this cross-sectional view.

FIG. 1 is a front view of a speaker 10 according to a first embodiment of the present invention. FIG. 2A is a cross-sectional view taken along line A-A' shown in FIG. 1. An enclosure 11 of the speaker 10 has an opening 12 and a cavity 13 that communicates with the opening 12. The enclosure 11 has an approximately egg-shaped structure. The enclosure 11 has an outer wall having a constant thickness such that it surrounds the cavity 13. Furthermore, the enclosure 11 has an inner wall 14 that is curved such that the cavity 13 is formed so as to be approximately egg-shaped. A leg 16 is fixed to an outer wall 15 of the enclosure 11. The opening 12 of the enclosure 11 is configured to have a perfectly circular shape. A speaker unit 20 is mounted on the opening 12.

The speaker unit 20 is configured as an apparatus that emits sound waves that are compression waves in the air according to a received electric signal. The speaker unit 20 includes: a vibrating unit 21; a frame 22 arranged such that it covers the vibrating unit 21 from the cavity 13 side; a magnetic circuit 23 arranged on one end of the frame 22 such that it is on the opposite side to the vibrating unit 21; and a bobbin 24 arranged within a space defined by the frame 22 such that it is positioned between the vibrating unit 21 and the magnetic circuit 23.

The vibrating unit 21 includes a honeycomb core 25 having a hollow honeycomb structure and two films 26 and 27 each formed of an aluminum material and arranged so as to cover both sides of the honeycomb core 25. The films 26 and 27 of the vibrating unit 21 are configured to have a perfectly circular shape having a diameter that is slightly smaller than that of the opening 12. The outer edge of the film 26 of the vibrating unit 21 is held by the inner circumferential face of the opening 12 via an edge portion 49.

The frame 22 is configured to have an approximately conical shape. The frame 22 has two openings each having a perfectly circular shape along its axial direction. The frame 22 is fixed to the inner circumferential face portion of the opening 12 of the enclosure 11 such that one opening with the larger diameter from among the two openings faces the vibrating unit 21.

The magnetic circuit 23 is configured as a single unit obtained by monolithically integrating a yoke 28, a permanent magnet 29, and a plate 30. The magnetic circuit 23 is held by the vibrating unit 21 on the cavity 13 side thereof such that a magnetic gap GP2 faces the vibrating unit 21. More specifically, the yoke 28 of the magnetic circuit 23 includes a disk portion 31 and a center pole portion 32 that shares a central axis with the disk portion 31. The yoke 28 has a T-shaped cross-sectional structure (cross-sectional view shown in FIG. 2A) as viewed by taking a cross-section along a plane that passes through the common central axis shared by the disk portion 31 and the center pole portion 32.

The permanent magnet 29 is configured to have a circular shape. The permanent magnet 29 has an N pole on one end face (e.g., the end face 42) from among its end faces 42 and 43 facing each other in its thickness direction. Furthermore, the permanent magnet 29 has an S pole on the other end face (e.g., the end face 43). The permanent magnet 29 is configured to have an opening such that its inner diameter is greater than the outer diameter of the center pole portion 32. The end face 42 of the permanent magnet 29 is fixed to an end face 41 of the disk portion 31, the end face on which the center pole portion 32 is arranged. The center pole portion 32 is arranged such that it protrudes toward the end face 43 side of the permanent magnet 29 along an approximately central axis of the opening formed in the permanent magnet 29.

The plate 30 has a circular structure thinner than the permanent magnet 29. The plate 30 has an opening having an inner diameter that is greater than the outer diameter of the center pole portion 32, and that is smaller than the inner diameter of the opening formed in the permanent magnet 29. One end face 44 of the plate 30 is fixed to the end face 43 of the permanent magnet 29. The other end face 45 of the plate 30 is fixed to an end face 46 of the frame 22 formed such that it surrounds the smaller-diameter opening of the frame 22. The inner circumferential face of the opening formed in the plate 30 surrounds the outer circumferential face of a part of the center pole portion 32 protruding from the permanent magnet 29. With such an arrangement, the magnetic gap GP2 is defined as a gap between the inner circumferential face of the plate 30 and the outer circumferential face of the center pole portion 32.

Figure 3:
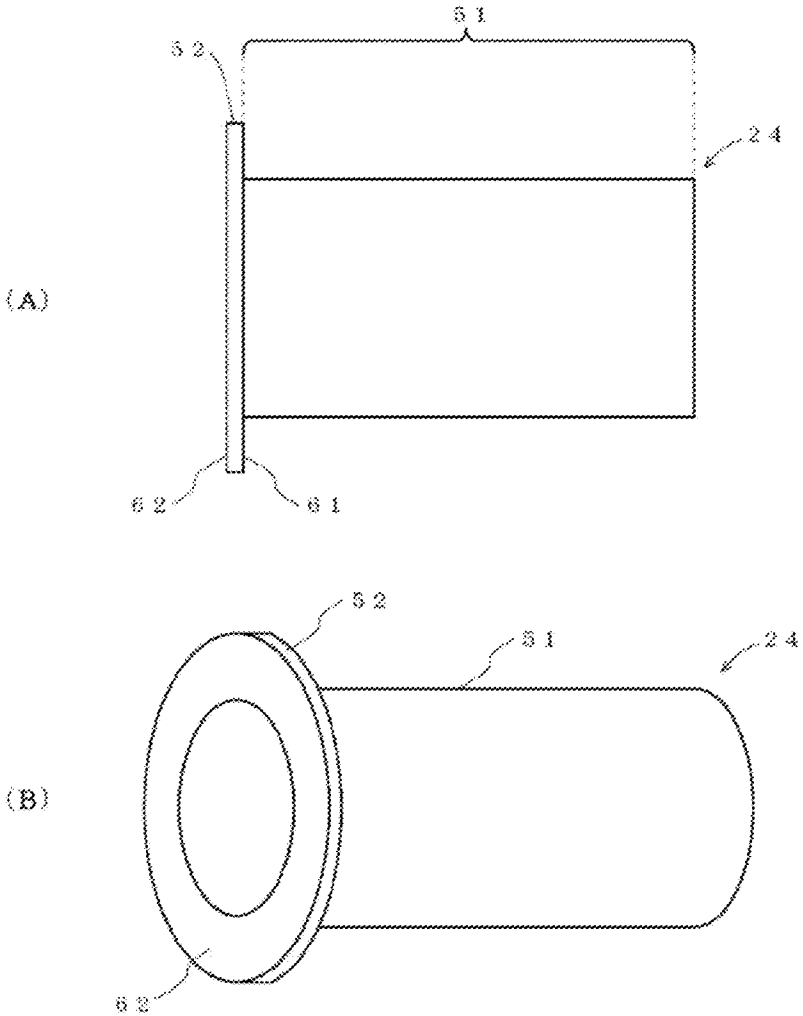
FIG. 3 is a side view and a perspective view of a bobbin included in the speaker shown in FIG. 1.

The bobbin 24 is configured including: a cylindrical portion 51 (FIG. 2B) having a cylindrical structure in which a coil 48 is wound around one end thereof; and a flange portion 52 (FIG. 2B) that is arranged on the other end of the cylindrical portion 51 that is opposite to the aforementioned end around which the coil 48 is wound, and that is formed such that it extends outward in the radial direction of the bobbin 24. A damper 47 is arranged between the outer circumferential face of the cylindrical portion 51 of the bobbin 24 and the inner circumferential face of the frame 22. FIG. 3A is an enlarged view showing the bobbin 24 shown in FIG. 2A. FIG. 3B is a perspective view of FIG. 3A. As shown in FIGS. 3A and 3B, the flange portion 52 of the bobbin 24 is configured to have a circular shape. The flange portion 52 is configured to have a radial width (width of the flange portion 52 along a direction from its center toward its outer circumferential face) that is smaller than the diameter of the cylindrical portion 51. Furthermore, the flange portion 52 has end faces 61 and 62 facing each other in the thickness direction of the flange portion 52, and such that they are orthogonal to the longitudinal direction of the cylindrical portion 51.

As shown in FIG. 2A, the end of the bobbin 24 around which the coil 48 is wound is arranged within the magnetic gap GP2 defined by the magnetic circuit 23. Furthermore, as shown in the enlarged view in FIG. 2B, the end face 62 of the flange portion 52, which is an end of the bobbin 24 that is opposite to the other end thereof around which the coil 48 is wound, is bonded to the film 27 of the vibrating unit 21 by means of a flexible adhesive agent BND. The bobbin 24 is arranged such that the end face 62 of the flange portion 52 thereof and the film 27 of the vibrating unit 21 face each other in parallel. Furthermore, the flexible adhesive agent BND is applied between the end face 62 of the flange portion 52 and the film 27 of the vibrating unit 21 so as to form a layer having an approximately constant thickness.

With the magnetic circuit 23, the magnetic field flux generated by the permanent magnet 29 passes through a path including the yoke 28 and the plate 30. Furthermore, the magnetic field flux passes through the magnetic gap GP2. Thus, when a sound signal in the form of electric current is applied to the coil 48 of the bobbin 24, a driving force is applied to the bobbin 24 in a direction that is orthogonal to the longitudinal direction of the coil 48. This vibrates the bobbin 24 and the vibrating unit 21 to which the end of the bobbin 24 is bonded. The vibration of the vibrating unit 21 generates compression waves in the air, which are emitted toward the front side as sound waves.

The above is the detailed description of the configuration according to the present embodiment. The present embodiment provides the following effects.

First, the bobbin 24 has the flange portion 52 at its one end on the opposite side of the other end around which the coil 48 is wound, such that it extends outward in the radial direction of the bobbin 24. Furthermore, the flange portion 52 is bonded to the vibrating unit 21. Such an arrangement requires only a small amount of the adhesive agent BND to be applied to only a gap between the vibrating unit 21 and the flange portion 52 of the bobbin 24 to ensure a sufficient bonding strength. Thus, the present embodiment has an advantage of a reduced amount of the adhesive agent to be applied, as compared with a speaker having a structure in which the edge of the neck portion of the vibrating unit is bonded to the outer circumferential face of the bobbin such that they are in line contact with each other. Thus, the present embodiment provides a speaker having improved original sound reproduction capabilities as compared with a speaker having a structure in which the edge of the neck portion of the vibrating unit is bonded to the outer circumferential face of the bobbin such that they are in line contact with each other.

Second, with the present embodiment, the vibrating unit 21 comprises the honeycomb core 25 having a hollow honeycomb structure, and two films 26 and 27 each formed of an aluminum material arranged such that they cover both sides of the honeycomb core 25. Such an arrangement provides improved sound reproduction capabilities in a high frequency range, as compared with speakers including a vibrating unit having other configurations.

Third, with the present embodiment, the bobbin 24 includes the flange portion 52 having a ring shape at one end thereof, such that it extends outward in the radial direction of the bobbin 24. Furthermore, the flange portion 52 and the film 27 are arranged such that they face each other in parallel. Such an arrangement allows the adhesive agent BND to be applied to a bonding portion between the flange portion 52 and the film 27 with a constant thickness in a simple manner. Thus, with the present embodiment, such an arrangement reduces irregularities in the thickness of the adhesive agent BND applied to the bonding portion that connects the bobbin 24 and the vibrating unit 21. Such an arrangement further prevents detachment of the bobbin 24.

Fourth, with the present embodiment, the enclosure 11 has the curved inner wall 14 such that it defines the cavity 13 so as to be approximately egg-shaped. Thus, the present embodiment prevents the sound waves emitted from the vibrating unit 21 to the cavity 13 from reciprocating between the facing sides of the inner wall 14. Thus, the present embodiment is capable of suppressing the occurrence of standing waves in the cavity 13.

Second Embodiment

Figure 4:
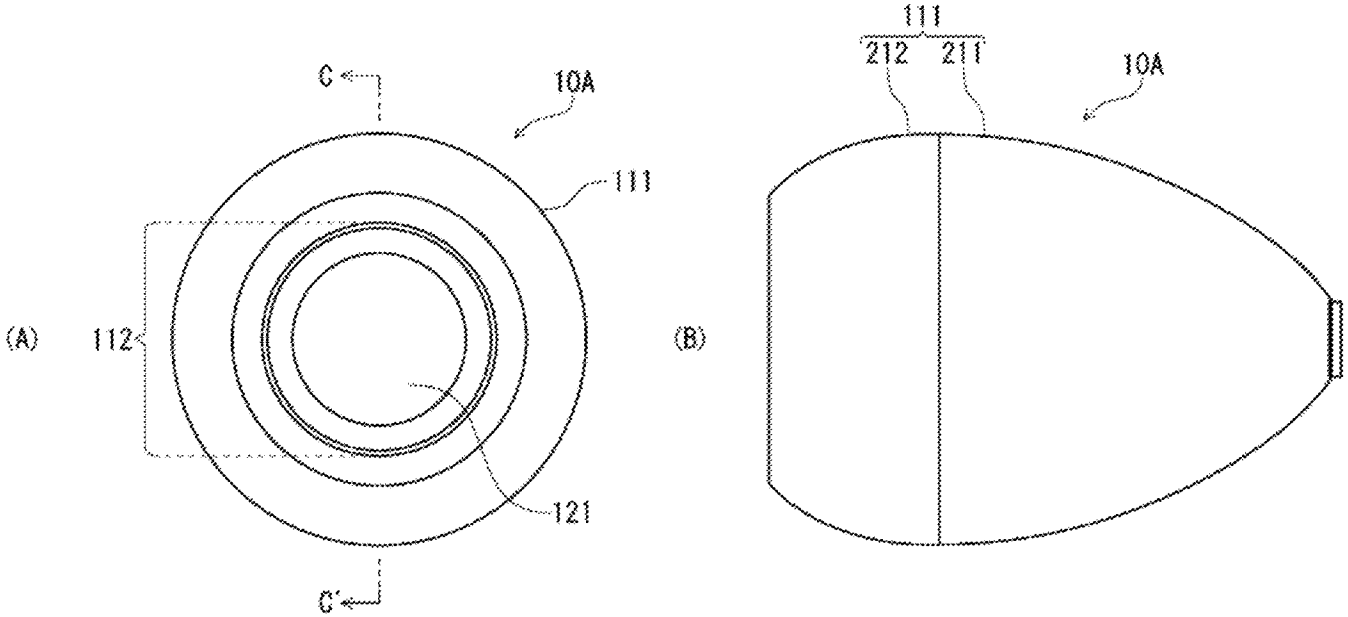
FIG. 4 is a front view and a side view showing a hearing-impaired person assistance speaker according to a second embodiment of the present invention.
Figure 5:
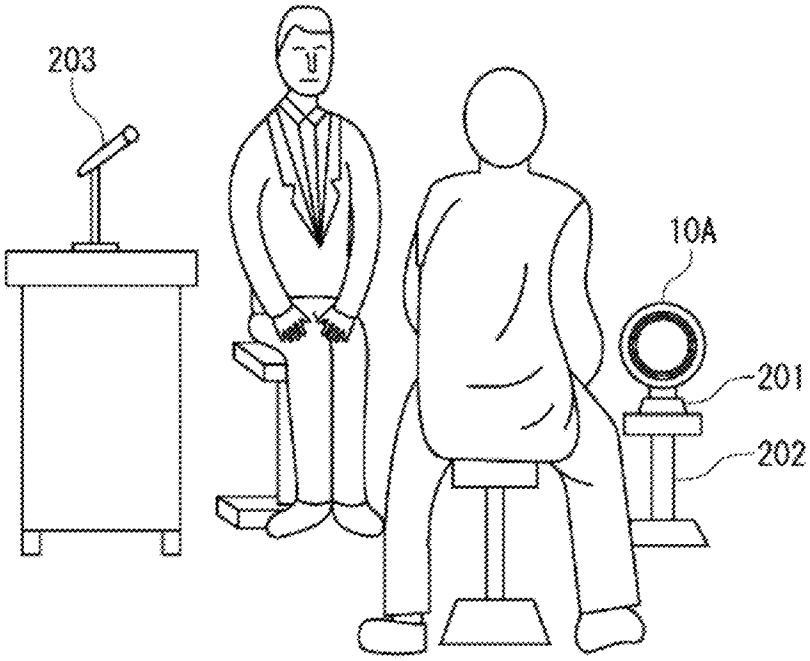
FIG. 5 is a diagram showing a usage of the hearing-impaired person assistance speaker shown in FIG. 4.

Next, description will be made regarding a hearing-impaired person assistance speaker 10A according to a second embodiment of the present invention. FIG. 4A is a front view of the hearing-impaired person assistance speaker 10A. FIG. 4B is a side view of the hearing-impaired person assistance speaker 10A. The hearing-impaired person assistance speaker 10A is configured in order to support communication between a hearing-impaired person and a doctor in a medical office in a medical institution. FIG. 5 is a diagram showing the usage of the hearing-impaired person assistance speaker 10A. As shown in FIG. 5, the hearing-impaired person assistance speaker 10A mounted on a leg 201 is placed on a table 202 on the front side of a seat for the hearing-impaired person in the medical office. The hearing-impaired person assistance speaker 10A is connected to a microphone 203 placed in the vicinity of a seat of the doctor via a cable (not shown). The microphone 203 acquires the sound emitted by the doctor, and outputs a sound signal. The hearing-impaired person assistance speaker 10A emits the sound signal in the form of sound toward the hearing-impaired person.

Figure 6:
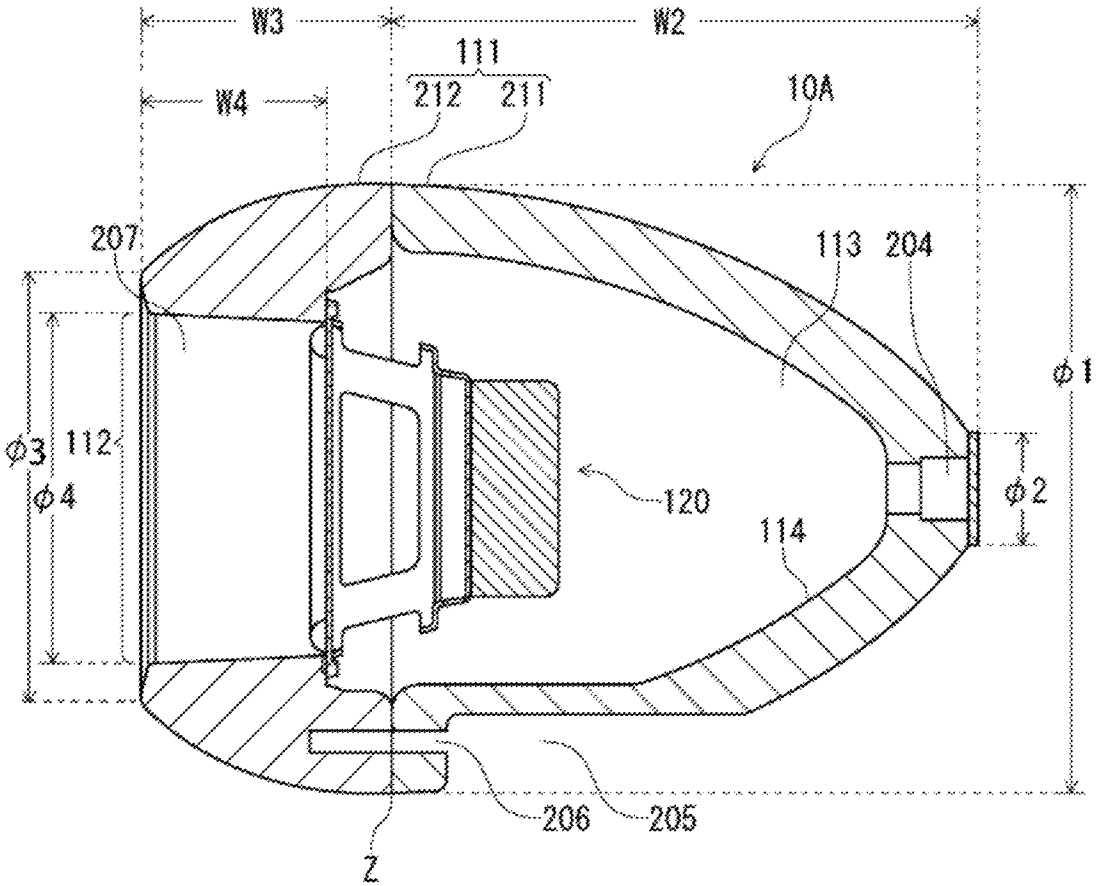
FIG. 6 is a cross-sectional view taken along line C-C' shown in FIG. 4A.

FIG. 6 is a cross-sectional view taken along line C-C' in FIG. 4A. As shown in FIGS. 4A and 4B and FIG. 6, the hearing-impaired person assistance speaker 10A includes an enclosure 111 and a speaker unit 120 housed in the enclosure 111. The enclosure 111 has a structure in which two cup bodies 211 and 212 are coupled with each other so as to form a single unit having an egg-shaped cavity. The cup bodies 211 and 212, which are components of the enclosure 111, each have an outer circumferential periphery having a maximum diameter $\phi 1$ ($\phi 1$=108.01 mm) at a coupling portion Z at which they are coupled with each other. The diameter of the outer circumferential periphery of the cup body 211 becomes gradually smaller according to an increase in the distance from the coupling portion Z toward the rear side. The outer circumferential periphery of the cup body 211 has a minimum diameter $\phi 2$ ($\phi 2$=20.00 mm) at a position on the rear side of the enclosure 111 at a distance of W2 (W2=103.12 mm) from the coupling portion Z. The cup body 211 has an inner wall 114 having an egg shape (more specifically, a half-egg shape) such that it faces a cavity 113 defined by the cup body 211.

An opening 204 is formed in the cup body 211, which is configured as an aperture that communicates between its rear end and the cavity 113 configured as an internal space. The opening 204 is formed in order to allow a cable to be inserted into the enclosure 111. A recess 205 is formed in the outer wall of the cup body 211 such that it is recessed toward the cavity 113 side. Furthermore, the enclosure 111 has a hole 206 extending from the recess 205 toward the cup body 212 so as to form an aperture in the cup body 211. The recess 205 and the hole 206 are formed in order to allow the leg 201 (FIG. 5) to be mounted.

The diameter of the outer circumferential periphery of the cup body 212 becomes gradually smaller according to an increase in the distance from the coupling portion Z toward the front side. The outer circumferential periphery of the cup body 212 has a minimum diameter $\phi 3$ ($\phi 3$=77.09 mm) at a position toward the front side from the coupling portion Z by the distance of W3 (W3=44.90 mm.) An aperture 207 is formed in the cup body 212 so as to form an opening 112 at the front end of the cup body 212 such that it extends toward the cavity 113 side in the form of a straight pipe. The aperture 207 has a diameter $\phi 4$ ($\phi 4$=61.89 mm) and a depth W4 (W4=30.00 mm).

Figure 7:
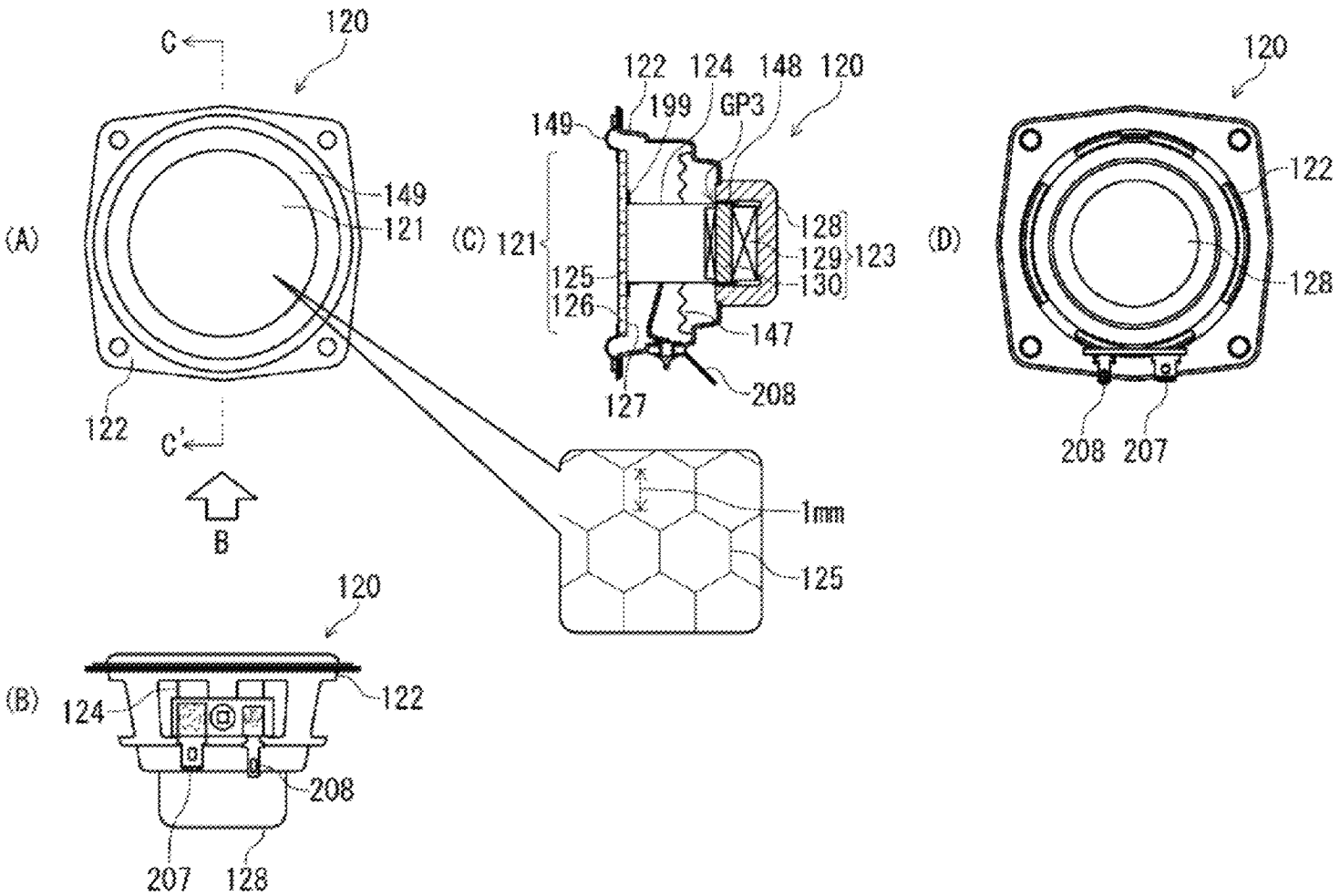
FIG. 7 is a front view, a bottom view, a cross-sectional view, and a back view of the hearing-impaired person assistance speaker shown in FIG. 4.

The speaker unit 120 is fixed to an edge of the other one opening of the aperture 207, which is an opening that is opposite to the opening 112, such that a vibrating unit 121 faces the opening 112. FIG. 7A is a front view of the speaker unit 120. FIG. 7B is a view (bottom view) as viewed in the arrow B direction in FIG. 7A. FIG. 7C is a cross-sectional view taken along line C-C' in FIG. 7A. FIG. 7D is a back view of FIG. 7A. As shown in FIGS. 7A, 7B, 7C, and 7D, the vibrating unit 121 is embedded in the front face of a frame 122 of the speaker unit 120. The vibrating unit 121 is held by the opening on the front side of the frame 122 via its edge 149.

The vibrating unit 121 includes a honeycomb core 125 and two films 126 and 127 each formed of an aluminum material and arranged so as to cover both sides of the honeycomb core 125. In the vibrating unit 121, the two films 126 and 127 are each bonded to the honeycomb core 125 by means of an adhesive agent. As shown in the enlarged view frame in FIG. 7, the honeycomb core 125 of the vibrating unit 125 has a regular hexagonal honeycomb structure. Each side of each regular hexagonal unit of the honeycomb core 125 has a length of 1 mm.

A magnetic circuit 123 is held by the frame 122 on the rear side of the vibrating unit 121. The magnetic circuit 123 is configured by monolithically integrating a pot yoke 128, a permanent magnet 129, and a pole piece 130. A magnetic gap GP3 (a circular gap between the pole piece 130 and the pot yoke 128) formed in the magnetic circuit 123 is arranged such that it faces the vibrating unit 121.

A combination obtained by coupling a bobbin 124 and a coupler 199 is arranged within a space defined by the frame 122 such that it is positioned between the magnetic circuit 123 and the vibrating unit 121. The bobbin 124 is configured to have a cylindrical shape, which is a point of difference from the first embodiment. The coupler 199 is configured to have a cylindrical shape having a height that is sufficiently smaller than that of the bobbin 124 and having one end extending outward in its radial direction. The inner circumferential face of the coupler 199 has the same diameter as that of the outer circumferential face of the bobbin 124. A coil 148 is wound around one end of the bobbin 124. The one end of the bobbin 124 around which the coil 148 is wound is arranged within the magnetic gap GP3. The other end of the bobbin 124, which is an end opposite to the end around which the coil 148 is wound, is arranged within the coupler 199. The inner circumferential face of the coupler 199 and the outer circumferential face of the bobbin 124 are bonded in contact with each other. The portion of the coupler 199 extending outward in the radial direction is bonded to the vibrating unit 121. A damper 147 is arranged between the outer circumferential face of the bobbin 124 and the inner circumferential face of the frame 122.

A positive electrode 207 and a negative electrode 208 are provided to the frame 122. The positive electrode 207 and the negative electrode 208 are connected to the respective terminals of the coil 148 wound around the bobbin 124. Furthermore, the positive electrode 207 and the negative electrode 208 are each connected to wires of a cable inserted into the cavity 113 via the opening 204.

The above is detailed description of the configuration of the present embodiment. The present embodiment provides the following effects.

First, with the present embodiment, the enclosure 111 of the hearing-impaired person assistance speaker 10A has an egg-shaped curved inner wall. As described above, in a case in which the enclosure 111 has such an inner wall curved in an egg shape, such a structure is capable of suppressing the occurrence of standing waves in the cavity 113. Thus, the present embodiment provides an advantage of preventing potential degradation of sound clarity due to interference from such standing waves that can occur in the enclosure 111. Thus, the present embodiment provides improved smooth communication between a doctor and a hearing-impaired person.

Second, with the present embodiment, the inner circumferential face of the coupler 199 is bonded to one end of the bobbin 124 that is opposite to the other end thereof around which the coil 148 is wound. Furthermore, the vibrating unit 121 is bonded to a portion of the coupler 199 configured such that the portion extends outward. As described above, in a case in which the bobbin 124 and the vibrating unit 121 are coupled with each other via the coupler 199 interposed between them, such an arrangement allows the bobbin 124 and the vibrating unit 121 to be coupled by means of surface contact bonding instead of line contact bonding. Thus, such an arrangement requires only a small amount of adhesive agent which is a material that leads to degradation in the sound clarity. Thus, the present embodiment provides further improved clarity of the sound to be received by a hearing-impaired person.

Third, with the present embodiment, the vibrating unit 121 includes the honeycomb core 125 having a hollow honeycomb structure and two films 126 and 127 each formed of an aluminum material. The films 126 and 127 are arranged such that honeycomb core 25 is interposed between the films 126 and 127. With a cone-type speaker unit, a vibrating sheet (paper cone) and a cap are vibrated so as to generate sound waves. In contrast, with a speaker unit having a hollow honeycomb structure, a film arranged on the front side, another film arranged on the back side, and the honeycomb core are vibrated so as to generate sound waves. Thus, a speaker unit having a hollow honeycomb structure has a larger area that contributes to sound wave generation than that of a speaker unit having a cone-type speaker unit if their respective sound emitting planes have the same area. Accordingly, the speaker unit having a hollow honeycomb structure allows the sound waves to have an increased volume velocity according to an increase in the sound wave generating area due to the film arranged on the back side and the honeycomb core. Thus, the present embodiment provides a compact-size and portable hearing-impaired person assistance speaker that is capable of emitting sound waves having a sufficient sound pressure level required for the listening comprehension of a hearing-impaired person.

Fourth, in the present embodiment, the vibrating unit 121 is held within the aperture 207 formed in the enclosure 111 at a position that is recessed closer to the inner side of the cavity 113 than the opening 112. In a case in which the vibrating unit 121 is arranged at a position that is closer to the inner side than the opening 112, such an arrangement provides stronger sound directionality in comparison to that provided by an arrangement in which the vibrating unit 121 is arranged within the aperture 207 such that it is approximately flush with the opening 112. Thus, with such an arrangement, there is reduced attenuation of the sound in the front direction to the extent that the sound directionality is stronger. Therefore, with the present embodiment, in a case in which the hearing-impaired person assistance speaker 10A is installed so as to face a hearing-impaired person, the hearing-impaired person is able to hear sound with an improved sound pressure level. Thus, the present embodiment provides a hearing-impaired person assistance speaker that requires only small power consumption to emit sound waves having a sufficient sound pressure level required for the listening comprehension of a hearing-impaired person.

Fifth, with the present embodiment, the honeycomb core 125 of the vibrating body has a regular hexagonal honeycomb structure. Each side of each regular hexagonal unit of the honeycomb core 125 has a length of 1 mm. With such a vibrating body having such a hollow honeycomb structure, the volume velocity of the sound waves becomes greater according to an increase in the area of the honeycomb core structure. Accordingly, from the viewpoint of improving the sound pressure level, as an effective approach, each hexagonal unit of the honeycomb core is preferably configured to have as small an area as possible so as to allow the honeycomb core structure to have as large an area as possible. However, in the vibrating body, each film is bonded to the honeycomb core by means of an adhesive agent. Accordingly, in a case in which each hexagonal unit of the honeycomb core is configured to have an excessively small area, such an arrangement has the potential to have a problem in that the space in each hexagonal unit between the two films is filled with the adhesive agent, leading to degradation of the sound clarity. The present inventors tested the sound clarity levels for such vibrating bodies having various honeycomb core dimensions. As a result, the present inventors have confirmed that there is a need to set a lower limit of 1 mm for the size of each hexagonal unit in order to ensure the sound clarity level. Thus, the present embodiment provides further improved ease of listening comprehension for a hearing-impaired person.

Here, the present inventors assume that the ease of listening comprehension at a given hearing point with respect to the sound of speech from a microphone emitted via a speaker depends on two factors, i.e., the sound pressure (dB) and the sound clarity level. Given such an assumption, the present inventors have performed four verification experiments as follows. In the first verification experiment, the present inventors selected, as comparison targets, two types of speakers, i.e., a speaker having a configuration in which a honeycomb flat-type speaker unit is mounted on an egg-shaped enclosure and a speaker having a configuration in which a cone-shaped speaker unit is mounted on a box-shaped enclosure.

In these experimental conditions, four hearing-impaired persons were selected as subjects. Using the aforementioned two types of speakers, words selected from the S57-S word tables (speech inspection term tables consisting of a number word table and a table of 50 monosyllabic Japanese words defined by the Japan Audiology Society) are each emitted at the same sound pressure level. Each subject answered the word which he/she heard, and the test results of whether the answers were correct or not were recorded. For all four subjects, in a case in which the test was performed using the egg-shaped speaker, there was a greater number of cases of success in sound listening comprehension. Furthermore, all four subjects commented that their ease of listening comprehension was greater when the test was performed using the egg-shaped speaker. The test results have confirmed that the hearing-impaired person assistance speaker 10A provides improved performance from the viewpoint of sound listening comprehension, as compared with typical acoustic speakers (a configuration in which a cone-shaped speaker unit is mounted on a box-shaped enclosure) according to conventional techniques.

Figure 8:
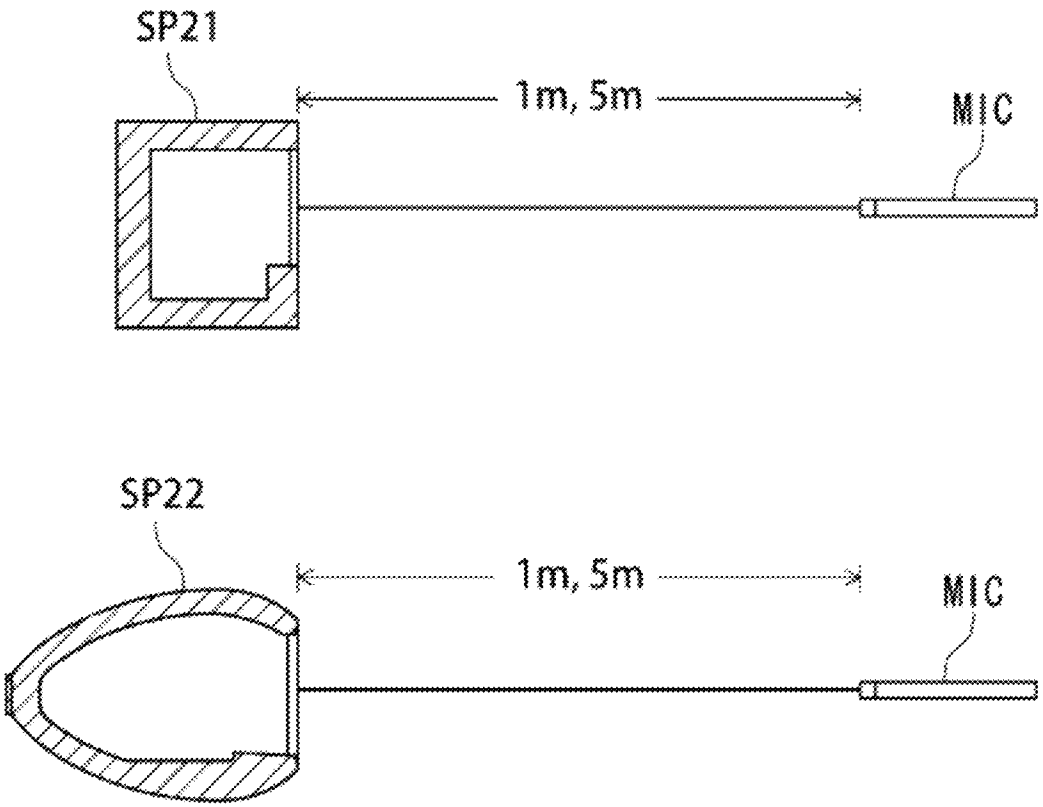
FIG. 8 is a diagram showing the experimental conditions for verifying the effects provided by the second embodiment of the present invention.

In the second verification experiment, as shown in FIG. 8, the present inventors selected, as comparison targets, two types of speakers, i.e., a speaker SP21 having a configuration in which a honeycomb flat-type speaker is mounted on a box-shaped enclosure such that it is approximately flush with the front opening, and a speaker SP22 having a configuration in which a honeycomb flat-type speaker is mounted on an egg-shaped enclosure such that it is approximately flush with the front opening. Furthermore, these two types of speakers SP21 and SP22 are configured such that the sound emitting planes of the respective speaker units have the same area, and such that the cavities formed in the respective enclosures have the same volume.

Under these conditions, the present inventors selected, as two microphone MIC setting points (measurement points), a point toward the front side at a distance of 1 m away from the center of the vibrating unit of each of the two types of speakers SP21 and SP22, and a point toward the front side at a distance of 5 m away from the center of the vibrating unit. Subsequently, the average sound pressure level was measured at the measurement points in a state in which a sine waveform signal was input to each of the speakers SP21 and SP22 with a frequency of 400 Hz and 800 Hz. The average time used to obtain the time-average sound pressure level was 10 seconds. The measurement results are listed in the following tables.

TABLE 1

| | Time-average sound pressure level (sine waveform signal 400 Hz) | |
|---|---|---|
| Speaker Type | 1 m | 5 m |
| Speaker SP21 | 73.9 dB | 58.8 dB |
| Speaker SP22 | 79.4 dB | 63.9 dB |

TABLE 2

| | Time-average sound pressure level (sine waveform signal 800 Hz) | |
|---|---|---|
| Speaker Type | 1 m | 5 m |
| Speaker SP21 | 73.2 dB | 58.6 dB |
| Speaker SP22 | 81.4 dB | 66.2 dB |

The measurement results show that the speaker SP22 provided a higher time-average pressure sound level for both the measurement point at a distance of 1 m and the measurement point at a distance of 5 m. This measurement result confirms that a speaker having an egg-shaped enclosure provides an increased sound pressure level for each hearing point defined on the front side.

Figure 9:
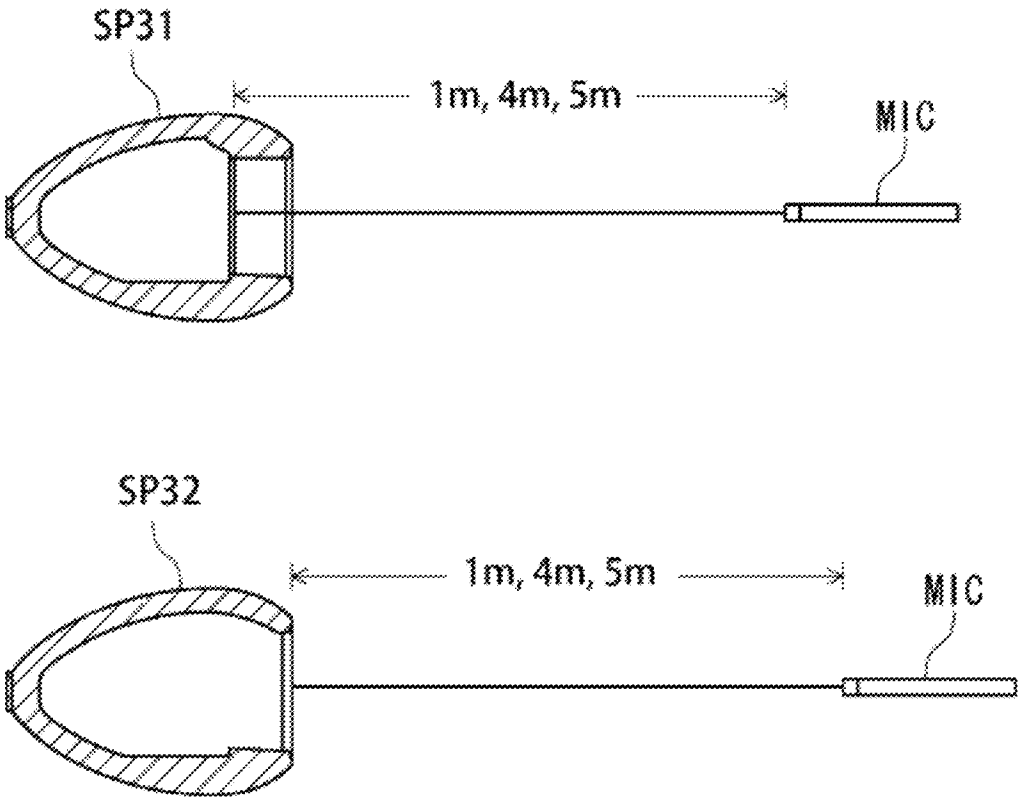
FIG. 9 is a diagram showing the experimental conditions for verifying the effects provided by the second embodiment of the present invention.

In the third verification experiment, as shown in FIG. 9, the present inventors selected, as comparison targets, two types of speakers, i.e., a speaker SP31 having the same configuration as that of the hearing-impaired person assistance speaker 10A according to the aforementioned second embodiment, and a speaker S32 having the same configuration as that of the speaker SP31 except that the speaker unit 120 is mounted at a position shifted 25 mm toward the front side as compared with the mounting position of the speaker SP31.

Under these conditions, the present inventors selected, as three microphone MIC setting points (measurement points), a point toward the front side at a distance of 1 m away from the center of the vibrating unit of each of the two types of speakers SP31 and SP32, a point toward the front side at a distance of 4 m away from the center of the vibrating unit, and a point toward the front side at a distance of 5 m away from the center of the vibrating unit. Subsequently, the sound pressure level was measured for each of the measurement points in a state in which a sine waveform signal was input to each of the speakers SP31 and SP32 with a frequency ranging from 20 Hz to 20,000 Hz.

Figure 10:
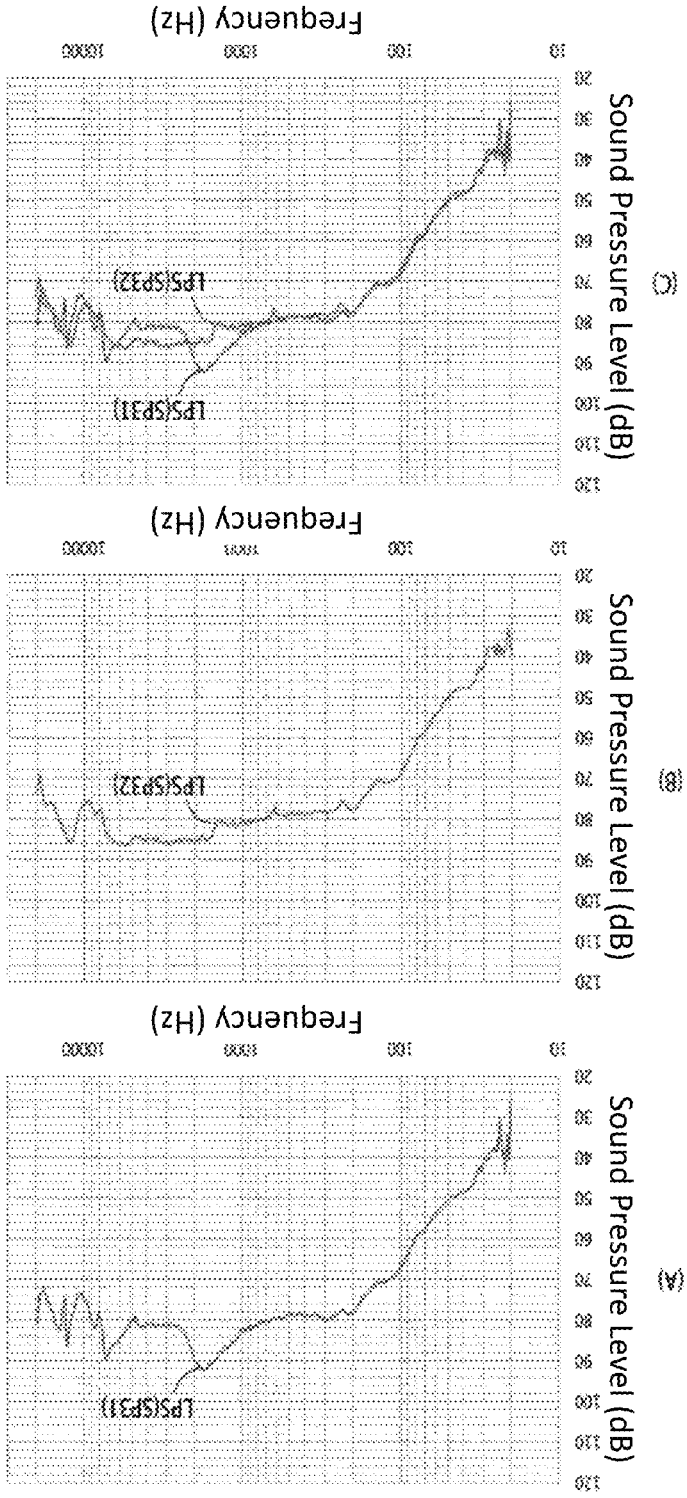
FIG. 10 is a diagram showing the verification experiment results showing the effects provided by the second embodiment of the present invention.

FIG. 10A is a graph LPS (SP31) showing the measurement values of the sound pressure level provided by the speaker SP31 when there was a distance of 1 m between the speaker SP31 and the microphone MIC. FIG. 10B is a graph LPS (SP32) showing the measurement values of the sound pressure level provided by the speaker SP32 when there was a distance of 1 m between the speaker SP32 and the microphone MIC. FIG. 10C is a graph showing the two graphs, i.e., LPS (SP31) shown in FIG. 10A and LPS (SP32) shown in FIG. 10B overlaid such that their frequency axes match each other.

Figure 11:
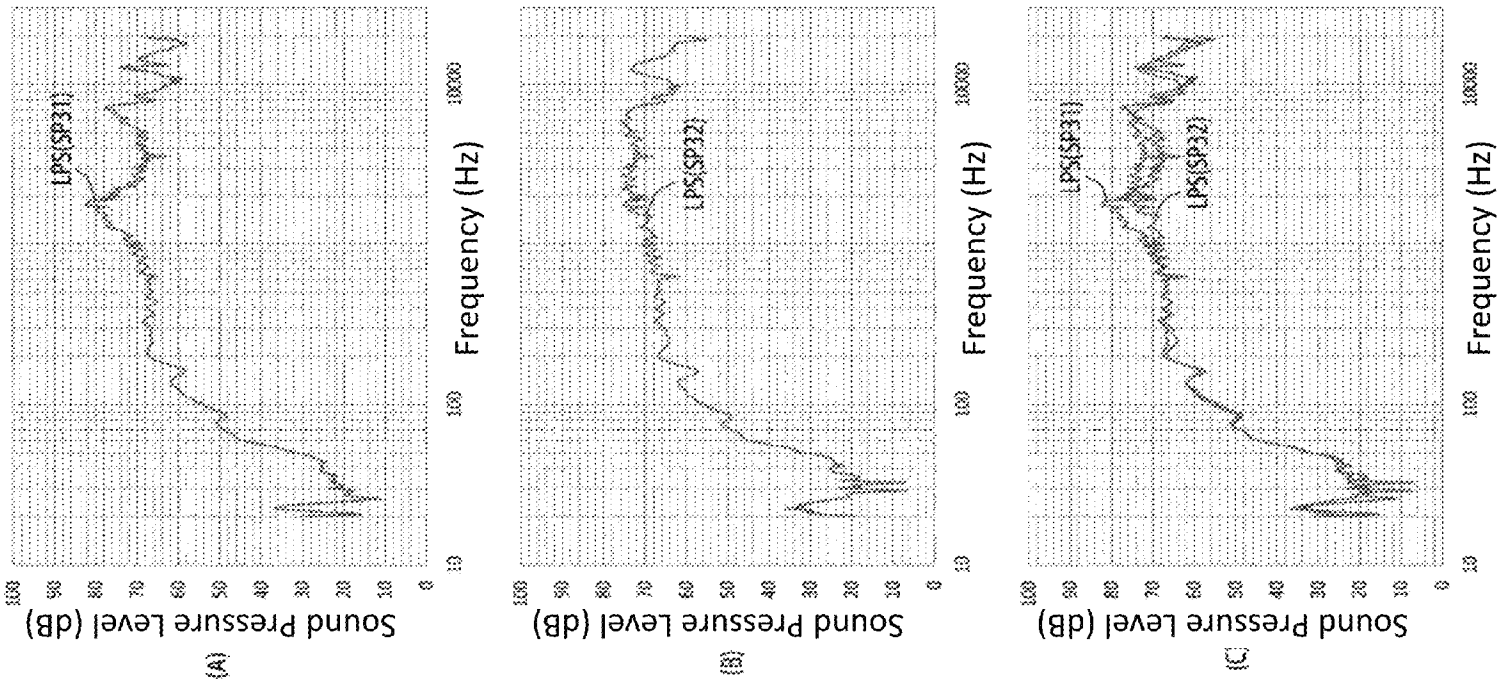
FIG. 11 is a diagram showing the verification experiment results showing the effects provided by the second embodiment of the present invention.

FIG. 11A is a graph LPS (SP31) showing the measurement values of the sound pressure level provided by the speaker SP31 when there was a distance of 4 m between the speaker SP31 and the microphone MIC. FIG. 11B is a graph LPS (SP32) showing the measurement values of the sound pressure level provided by the speaker SP32 when there was a distance of 4 m between the speaker SP32 and the microphone MIC. FIG. 11C is a graph showing the two graphs, i.e., LPS (SP31) shown in FIG. 11A and LPS (SP32) shown in FIG. 11B overlaid such that their frequency axes match each other.

Figure 12:
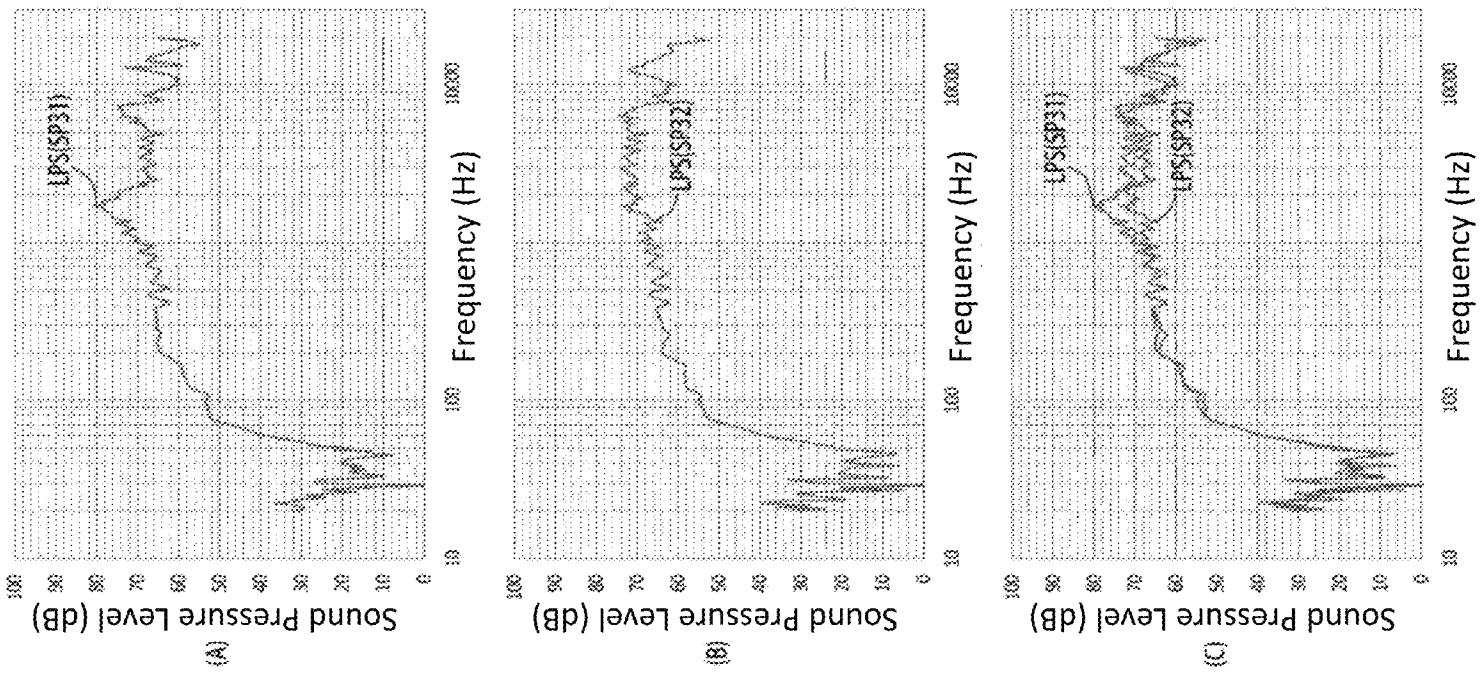
FIG. 12 is a diagram showing the verification experiment results showing the effects provided by the second embodiment of the present invention.

FIG. 12A is a graph LPS (SP31) showing the measurement values of the sound pressure level provided by the speaker SP31 when there was a distance of 5 m between the speaker SP31 and the microphone MIC. FIG. 12B is a graph LPS (SP32) showing the measurement values of the sound pressure level provided by the speaker SP32 when there was a distance of 5 m between the speaker SP32 and the microphone MIC. FIG. 12C is a graph showing the two graphs, i.e., LPS (SP31) shown in FIG. 12A and LPS (SP32) shown in FIG. 12B overlaid such that their frequency axes match each other.

These measurement results show that, for all three measurement points, i.e., the 1 m measurement point, 4 m measurement point, and 5 m measurement point, the speaker SP31 provides a higher sound pressure level in a frequency range between 1 kHz and 2 kHz, which is known as a frequency range that can have a large effect on the ease of listening comprehension of a hearing-impaired person. These measurement results confirm that, in a case in which the speaker unit is mounted in the enclosure at a position shifted from its opening toward the rear side, such an arrangement provides an increased sound pressure level in such a frequency range that contributes to ease of listening comprehension on the front side.

Figure 13:
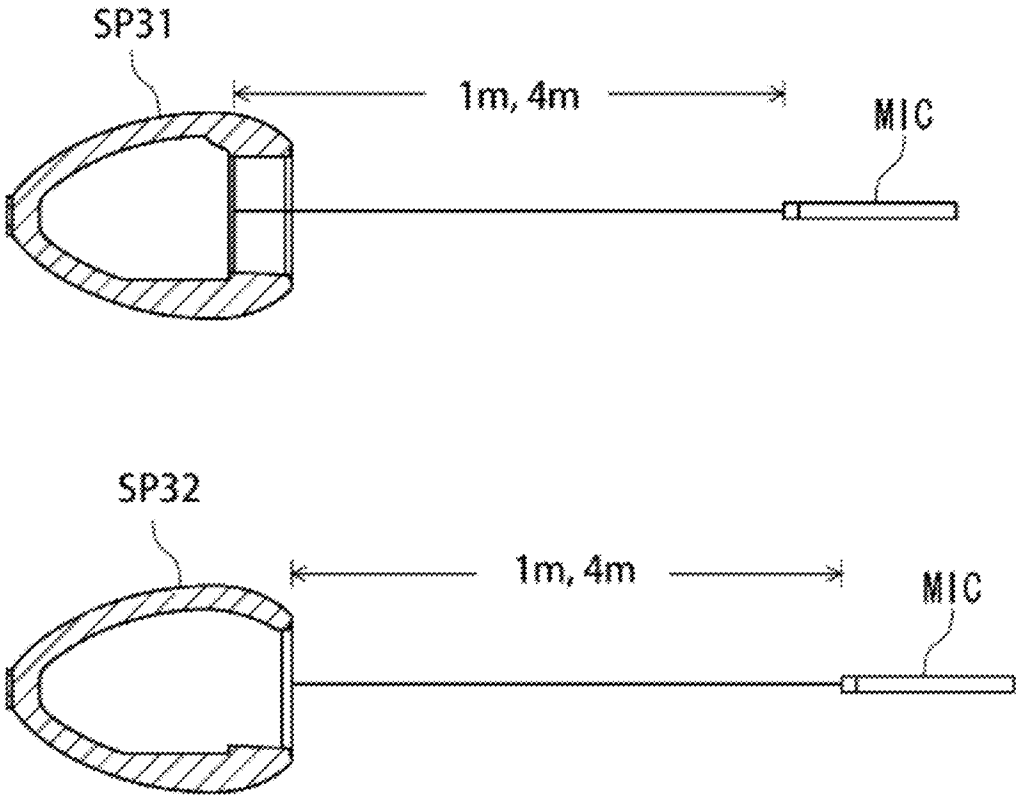
FIG. 13 is a diagram showing the experimental conditions for verifying the effects provided by the second embodiment of the present invention.

In the fourth verification experiment, as shown in FIG. 13, the present inventors selected, as comparison targets, the same two speakers as those used in the third verification experiment, i.e., the speaker SP31 (having the same configuration as that of the hearing-impaired person assistance speaker 10A), and the speaker SP32 (having the same configuration as that of the speaker SP31 except that the speaker unit is mounted at a position shifted 25 mm toward the front side).

Under these conditions, the present inventors selected, as two microphone MIC setting points (measurement points), a point toward the front side at a distance of 1 m away from the center of the vibrating unit of each of the two types of speakers SP31 and SP32, and a point toward the front side at a distance of 4 m away from the center of the vibrating unit. Subsequently, a sound signal was acquired via the microphone MIC for each measurement point in a state in which a white noise signal was input to the input terminal of each of the speakers SP31 and SP32. Furthermore, the sound signal thus acquired for each measurement point was subjected to FFT (Fast Fourier Transformation) processing so as to calculate the sound pressure level at a center frequency in ⅓ octave band analysis.

Figure 14:
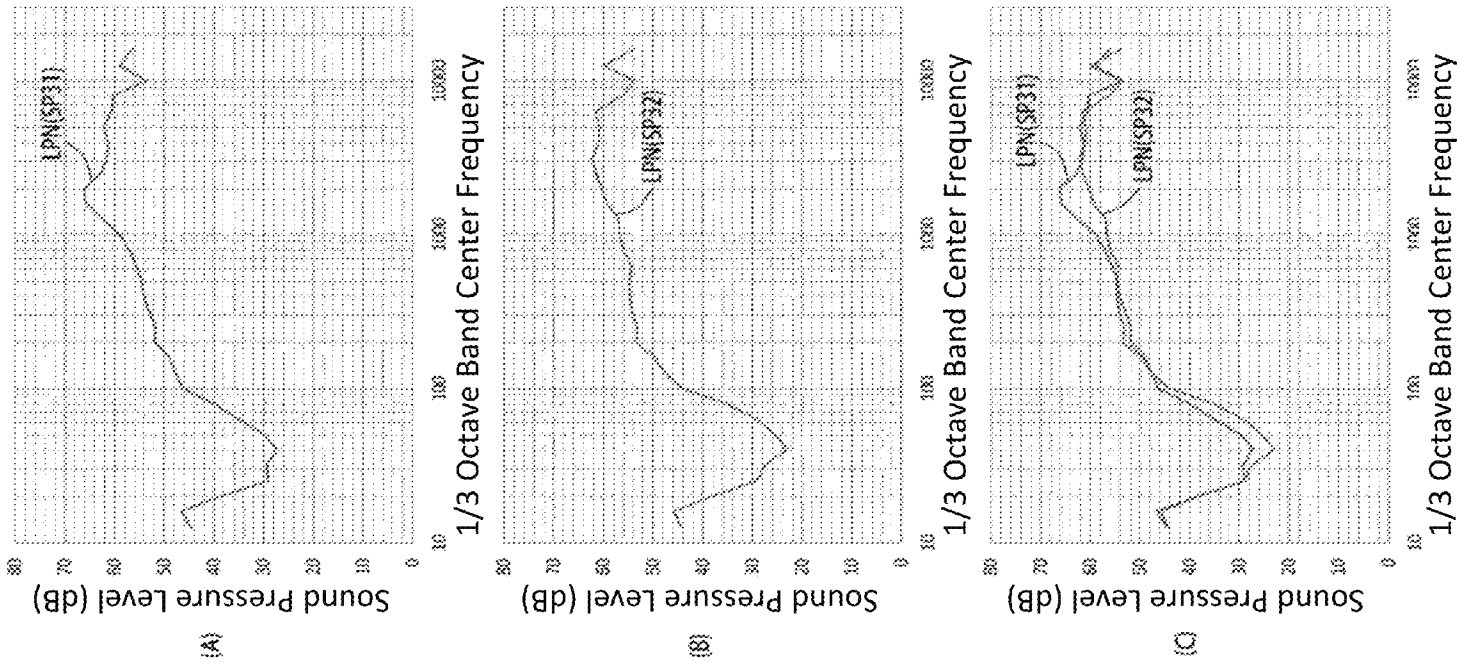
FIG. 14 is a diagram showing the verification experiment results showing the effects provided by the second embodiment of the present invention.

FIG. 14A is a graph LPN (SP31) showing the measurement values of the sound pressure level provided by the speaker SP31 when there was a distance of 1 m between the speaker SP31 and the microphone MIC. FIG. 14B is a graph LPN (SP32) showing the measurement values of the sound pressure level provided by the speaker SP32 when there was a distance of 1 m between the speaker SP32 and the microphone MIC. FIG. 14C is a graph showing the two graphs, i.e., LPN (SP31) shown in FIG. 14A and LPN (SP32) shown in FIG. 14B overlaid such that their frequency axes match each other.

Figure 15:
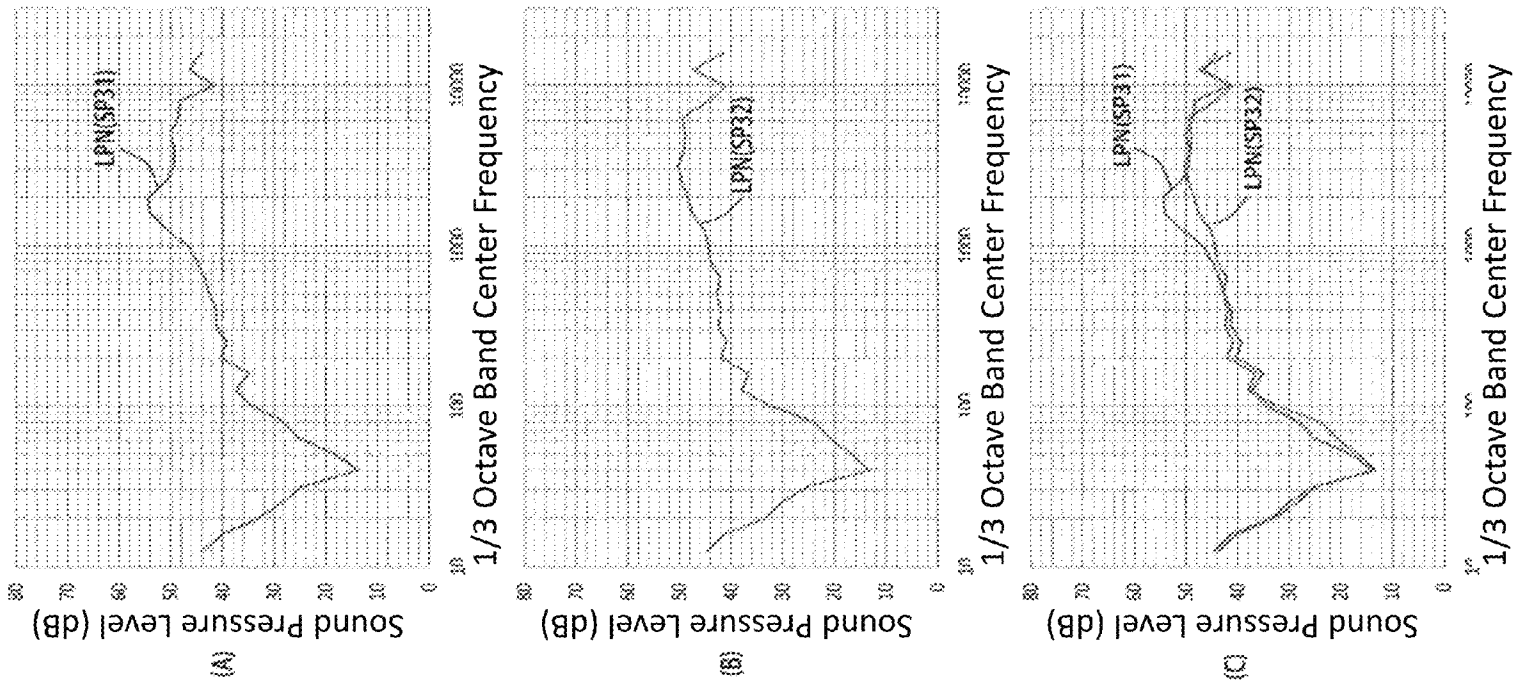
FIG. 15 is a diagram showing the verification experiment results showing the effects provided by the second embodiment of the present invention.
Figure 16:
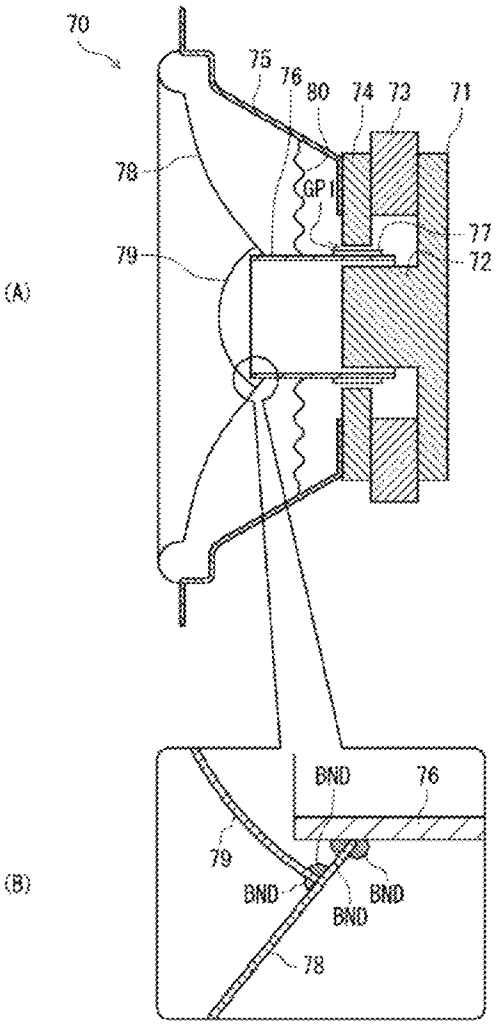
FIG. 16 is a cross-sectional view of a speaker according to a conventional technique and an enlarged view of a part of the cross-sectional view.

FIG. 15A is a graph LPN (SP31) showing the measurement values of the sound pressure level provided by the speaker SP31 when there was a distance of 4 m between the speaker SP31 and the microphone MIC. FIG. 15B is a graph LPN (SP32) showing the measurement values of the sound pressure level provided by the speaker SP32 when there was a distance of 4 m between the speaker SP32 and the microphone MIC. FIG. 15C is a graph showing the two graphs, i.e., LPN (SP31) shown in FIG. 15A and LPN (SP32) shown in FIG. 15B overlaid such that their frequency axes match each other.

These measurement results show that, for both measurement points, i.e., the 1 m measurement point and 4 m measurement point, the speaker SP31 provides a higher sound pressure level in a frequency range between 1 kHz and 2 kHz, which is known as a frequency range that can have a large effect on the ease of listening comprehension of a hearing-impaired person. These measurement results also confirm that, in a case in which the speaker unit is mounted in the enclosure at a position shifted from its opening toward the rear side, such an arrangement provides an increased sound pressure level in such a frequency range that contributes to ease of listening comprehension on the front side.

Description has been made regarding the first and second embodiments of the present invention. Also, the following modifications may be applied to such embodiments.

(1) In the aforementioned first embodiment, the enclosure is configured so as to be approximately egg-shaped. Also, the enclosure 11 may be configured to be box-shaped.

(2) Description has been made in the aforementioned first embodiment regarding an arrangement in which the vibrating unit 21 comprises the honeycomb core 25 and films 26 and 27. Also, such a vibrating unit 21 may be replaced by a structure comprising a paper cone sheet and a cap. In this case, the flange portion 52 of the bobbin 24, which is one end of the bobbin 24 that is opposite to the other end thereof around which the coil 48 is wound, may preferably be configured to have a slope having the same angle as the taper angle of the outer circumferential face of the paper cone sheet.

REFERENCE SIGNS LIST

10, 70 speaker, 11, 111 enclosure, 12, 112 opening, 113 cavity, 14 inner wall, 15 outer wall, 16, 201 leg, 21, 121 vibrating unit, 22, 122 frame, 23, 123 magnetic circuit, 24, 76, 124 bobbin, 25 125 honeycomb core, 26, 27, 126, 127 film, 28 yoke, 29, 129 permanent magnet, 30 plate, 31 disk portion, 32, 72 center pole portion, 48, 148 coil, 49 edge portion, 51 cylindrical portion, 52 flange portion, 71 back plate, 78 vibrating sheet, 79 cap.

The invention claimed is:

1. A hearing-impaired person assistance speaker which is configured to emit a sound signal in a form of sound toward a hearing-impaired person, the sound signal outputted from a microphone that acquired a sound, comprising:

an enclosure having an opening, and a cavity that communicates with the opening;

a vibrating unit held such that a sound emitting plane thereof faces the opening;

a magnetic circuit having a magnetic gap, and held in the cavity side such that the magnetic gap faces the vibrating unit;

a bobbin having a structure in which a coil is wound around an outer circumferential face of one end thereof, and the aforementioned one end around which the coil is wound is arranged within the magnetic gap; and a coupler having a cylindrical structure in which one end thereof is configured such that it extends outward, wherein an inner circumferential face of the coupler is bonded to the other end of the bobbin, i.e., an end opposite to the end thereof around which the coil is wound, wherein the portion of the coupler thus configured such that it extends outward is bonded to the vibrating unit, wherein the enclosure has an egg-shaped curved inner wall, wherein the vibrating unit comprises a honeycomb core having a hollow honeycomb structure and two films formed of an aluminum material and arranged so as to cover the honeycomb core from both sides thereof, wherein the vibrating unit is held in the enclosure at a position that is recessed closer to an inner side of the cavity than the opening, wherein a portion between the opening of the enclosure and the vibrating unit is configured to have a straight pipe shape, wherein the honeycomb core has a regular hexagonal honeycomb structure, wherein each regular hexagonal shape of the honeycomb core is configured to have sides having a length of 1 mm, wherein the enclosure has a structure in which a first cup body and a second cup body are coupled with each other so as to form a single unit having an egg-shaped cavity, wherein the first cup body and the second cup body are components of the enclosure, each have an outer circumferential periphery having a maximum diameter at a coupling portion at which the first cup body and the second cup body are coupled with each other, wherein a first hole is formed in the first cup body, which is configured as an aperture that communicates between a rear end of the first cup body and the cavity configured as an internal space, wherein a recess is formed in an outer wall of the first cup body such that the recess is recessed toward a side of the cavity, and wherein the enclosure has a second hole extending from the recess toward the second cup body so as to form an aperture in the second cup body.

* * * * *